US007331083B2

(12) United States Patent
Overvaag et al.

(10) Patent No.: US 7,331,083 B2
(45) Date of Patent: Feb. 19, 2008

(54) LIGHTED WAND ASSEMBLY WITH REMOTE LIGHT SOURCE

(75) Inventors: Chad D. Overvaag, Danville, KY (US); Robert M. Mayes, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 671 days.

(21) Appl. No.: 10/786,653

(22) Filed: Feb. 25, 2004

(65) Prior Publication Data

US 2004/0163200 A1 Aug. 26, 2004

Related U.S. Application Data

(63) Continuation-in-part of application No. 10/498,686, filed as application No. PCT/US03/40768 on Dec. 18, 2003.

(60) Provisional application No. 60/435,158, filed on Dec. 18, 2002.

(51) Int. Cl.
*A47L 9/30* (2006.01)

(52) U.S. Cl. ..... 15/324; 15/327.7; 15/353

(58) Field of Classification Search ..... 15/324, 15/327.1, 327.2, 327.3, 327.4, 327.5, 327.6, 15/327.7, 350–353, 415.1; *A47L 9/30*
See application file for complete search history.

(56) References Cited

U.S. PATENT DOCUMENTS

| | | | | |
|---|---|---|---|---|
| 2,637,062 | A | 5/1953 | Sutton et al. | |
| 2,682,604 | A | 6/1954 | Gerber | |
| 2,734,214 | A | 2/1956 | Gerber | |
| 3,668,842 | A * | 6/1972 | Batson et al. | 55/417 |
| 3,708,962 | A | 1/1973 | Deguchi et al. | |
| 4,443,910 | A | 4/1984 | Fitzwater | |
| 4,519,113 | A | 5/1985 | Hipple | |
| 4,980,945 | A | 1/1991 | Bewley | |
| 5,207,498 | A * | 5/1993 | Lawrence et al. | 362/91 |
| 5,311,639 | A * | 5/1994 | Boshier | 15/324 |
| 5,331,715 | A * | 7/1994 | Johnson et al. | 15/332 |
| 5,467,502 | A | 11/1995 | Johnson et al. | |
| 5,560,076 | A | 10/1996 | Leung | |
| 5,896,618 | A * | 4/1999 | Woo et al. | 15/324 |
| 5,983,443 | A | 11/1999 | Redding | |
| 6,003,196 | A * | 12/1999 | Wright et al. | 15/353 |
| 6,108,861 | A | 8/2000 | Vystrcil et al. | |
| 6,253,414 | B1 | 7/2001 | Bradd et al. | |
| 6,256,832 | B1 | 7/2001 | Dyson | |

(Continued)

FOREIGN PATENT DOCUMENTS

| | | |
|---|---|---|
| JP | 7-255650 | * 10/1995 |

(Continued)

*Primary Examiner*—Theresa T. Snider
(74) *Attorney, Agent, or Firm*—King & Schickli, PLLC

(57) ABSTRACT

A floor cleaning apparatus includes a housing, a dirt collector, a suction generator, a wand, a hose, a light source, a light director and a light transmitter. The light source is provided on the apparatus at a first point while the light director is provided on the apparatus at a second point remote from the first point. The light transmitter extends between the first and second points. The light source, transmitter and director all function together to direct light from the light source past the wand onto a work area to be cleaned.

18 Claims, 4 Drawing Sheets

U.S. PATENT DOCUMENTS

| | | | | |
|---|---|---|---|---|
| 6,289,552 | B1 * | 9/2001 | McCormick | 15/324 |
| 6,436,160 | B1 | 8/2002 | Stephens et al. | |
| 2001/0039692 | A1 | 11/2001 | Wright et al. | |
| 2002/0101730 | A1 | 8/2002 | Dilger et al. | |
| 2003/0182756 | A1 * | 10/2003 | Duggan | 15/347 |
| 2003/0196293 | A1 * | 10/2003 | Ruff | 15/324 |
| 2006/0075597 | A1 * | 4/2006 | Overvaag et al. | 15/324 |

FOREIGN PATENT DOCUMENTS

| | | |
|---|---|---|
| JP | 7255650 | 10/1995 |
| JP | 2000135187 | 5/2000 |

* cited by examiner 20
10
18
46
22
16
24
32
44
60
64
62
66
68
48
42
12
50
40
50
36
30
38
14
39
39

LIGHTED WAND ASSEMBLY WITH REMOTE LIGHT SOURCE

This application is a continuation-in-part of U.S. patent application Ser. No. 10/498,686 filed on Jun. 12, 2004 which is a 371 National Stage of International Patent Application Serial No. PCT/US03/40768 filed on Dec. 18, 2003 which claims the benefit of U.S. Provisional Patent Application Ser. No. 60/435,158 filed on Dec. 18, 2002.

TECHNICAL FIELD

The present invention relates generally to the floor care equipment field and, more particularly, to a lighted wand assembly for a floor cleaning appliance such as an upright vacuum cleaner or canister vacuum cleaner.

BACKGROUND OF THE INVENTION

Floor care cleaning equipment such as canister vacuum cleaners and upright vacuum cleaners have long been known in the art. During operation of such floor cleaning appliances one is almost ensured of having to clean in a poorly lit location where it is difficult to see the area of the floor being cleaned. Toward this end it has long been known to provide a light source on the powerhead or nozzle assembly to light the surface being cleaned.

It should, of course, be realized, however, that many upright vacuum cleaners are equipped with a wand that may be used for above floor cleaning. Similarly, the wand of a canister vacuum cleaner may be utilized for the same purpose. A lighted powerhead or nozzle assembly is not of any benefit when cleaning above the floor with the wand alone or the wand and another attachment in the absence of the powerhead.

The present invention relates to a light source that is mounted on the wand to light the surface being cleaned whether it is the floor or an above floor surface such as a window sill, a chair bottom or the like.

SUMMARY OF THE INVENTION

In accordance with the purposes of the present invention as described herein, a canister vacuum cleaner is provided. That canister vacuum cleaner includes a main housing and both a dirt collector and suction generator carried by the main housing. Additionally, the vacuum cleaner includes a wand having a first end and a second end. A hose provides fluid communication between the first end of the wand and the suction generator. Additionally, a light source is carried at a first point on the vacuum cleaner. A light transmitter extends from the light source at the first point all the way to a second point, remote from the first point, whereby light from the light source is directed past the second end of the wand onto a surface being cleaned.

In one possible embodiment of the vacuum cleaner the dirt collector is a dirt cup. That dirt cup may include a dirt collection chamber having a cylindrical sidewall and a tangentially directed inlet to provide cyclonic airflow. In another possible embodiment the dirt collector is a replaceable dust bag.

The light source may take a number of forms. The light source may be one or more light emitting diodes, one or more incandescent bulbs, one or more flourescent bulbs, one or more halogen bulbs, one or more xenon bulbs or any mixture thereof.

The light transmitter may also take a number of forms. For example, the light transmitter may include a light pipe, a fiber optic cable, a fiber optic strand and combinations thereof. Additionally, a light director may be provided on the vacuum cleaner at the second point. The light director may, for example, be a lens, a prism or the like. Accordingly, light from the light source is transmitted along the light transmitter to the light director which then directs that light over the wand onto the work area.

In accordance with yet another aspect of the present invention, a floor cleaning apparatus is provided. The floor cleaning apparatus includes a nozzle assembly with a suction opening and a canister assembly pivotally connected to the nozzle assembly. Both a suction generator and a dirt collector are carried by one of the canister assembly and the nozzle assembly. A wand and hose assembly is carried by one of the canister assembly and the wand assembly and is provided in selective fluid communication with the suction generator. Additionally, a light source is carried at a first point on the floor cleaning apparatus. A light transmitter extends from the light source at the first point to a second point on the apparatus remote from the first. Light is thereby routed or directed from the light source past the wand onto a surface being cleaned.

In the following description there is shown and described several possible embodiments of this invention simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings.

Reference will now be made in detail to the present preferred embodiment of the invention, an example of which is illustrated in the accompanying drawing.

DETAILED DESCRIPTION OF THE INVENTION

Figure 1:
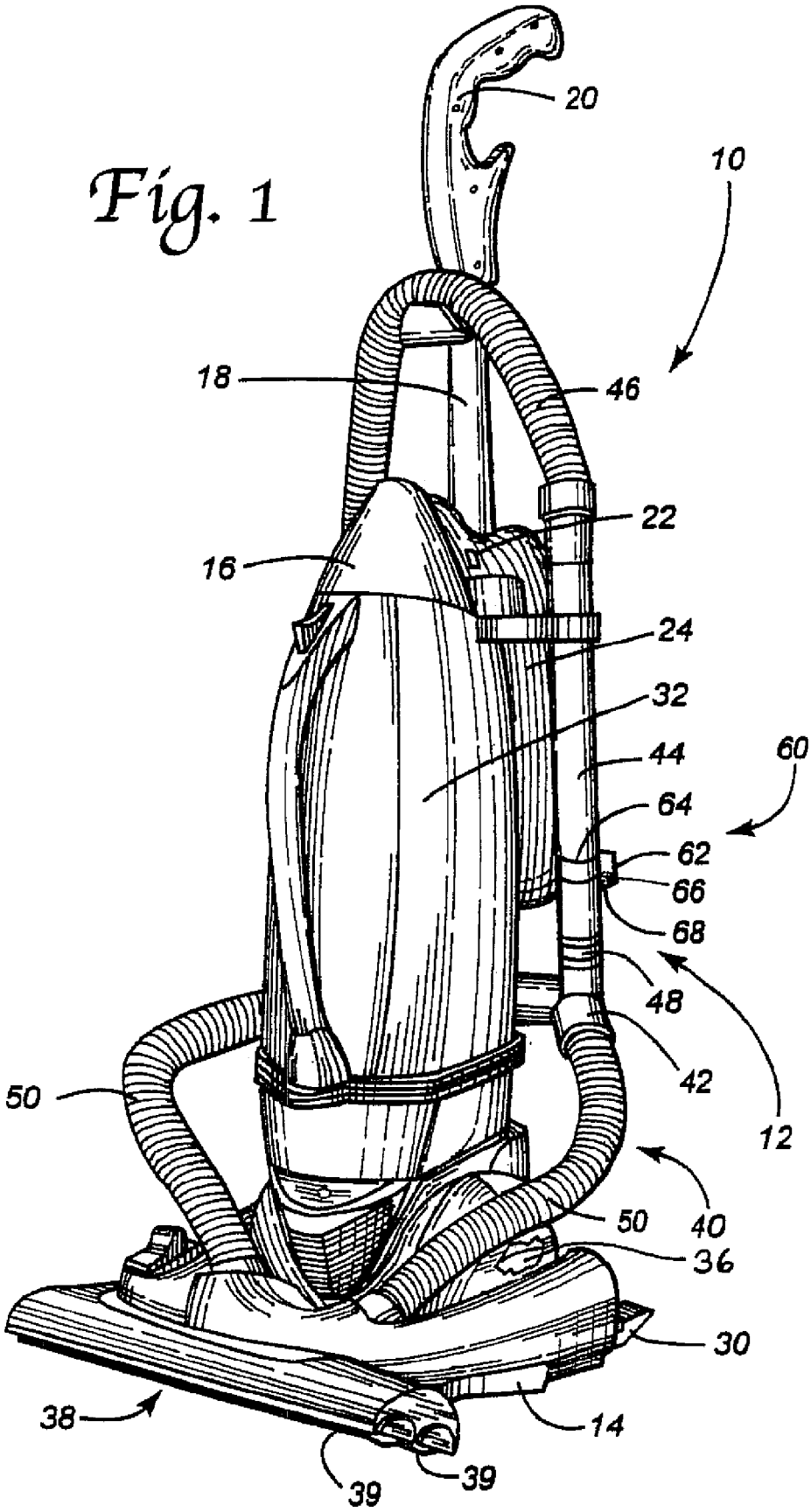
FIG. 1 is a side elevational view of an upright vacuum cleaner equipped with a lighted wand assembly.

Reference is now made to FIG. 1 showing an upright vacuum cleaner 10 equipped with the hand cleaning tool 12 of the present invention. The upright vacuum cleaner 10 includes a housing comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through an electrical cord 24.

A pair of rear wheels (not shown) are provided on a lower portion of the canister assembly 16 and a pair of front wheels (also not shown) are provided on the nozzle assembly 14. Together, these wheels support the vacuum cleaner 10 for movement across the floor. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated back and forth to clean the floor.

In the present preferred embodiment, the canister assembly 14 includes a cavity adapted to receive and hold a dirt container 32 which includes a collection chamber. A suction generator 36, including a fan and drive motor assembly, is carried on the canister assembly 14 and functions to generate a vacuum airstream for drawing dirt and debris from a surface to be cleaned. The suction generator may be carried on the canister assembly 16 or the nozzle assembly 14 if desired.

The nozzle assembly 14 includes a main inlet cavity 38 that houses a pair of agitators 39 which are rotated by the motor of the suction generator or a separate, dedicated motor relative to the nozzle assembly.

The main inlet cavity 38 of the nozzle assembly 14 is provided in fluid communication with the collection chamber of the dirt container 32 by means of an airflow system generally designated by reference numeral 40. That airflow system includes a T-shaped fitting 42, a wand 44 and a flexible hose 46. During floor cleaning, the cleaning end 48 of the wand is inserted and held in the fitting 42. Accordingly, the suction generator 36 draws air and entrained dirt and debris through the main inlet cavity 38 through the twin hoses 50 and the fitting 42, then up the wand 44 and through the flexible hose 46 into the collection chamber of the dirt cup 32. Dirt and debris collects in the dirt cup 32 as the air is then drawn through a filter (not shown) made of porous, pleated filter material or the like and through a secondary filter pad (not shown) into the compartment housing the suction generator 36. After passing over and cooling the motor, that air is discharged through a HEPA filter (not shown) through an exhaust port 52 into the environment.

In one possible embodiment, the dirt collection chamber of the dirt container 32 includes a substantially cylindrical sidewall and a tangentially directed inlet. This promotes cyclonic airflow in the collection chamber. That airflow enhances cleaning efficiency under many operating conditions. Still, it should be realized that the present invention need not be limited to cyclonic airflow systems. Accordingly, the dirt collection chamber may assume substantially any shape and the inlet may assume substantially any orientation and/or be formed in the sidewall, bottom wall or top wall of the dirt container 32.

At certain times and during particular cleaning operations such as when cleaning along baseboards or when desiring to use the cleaning tool to clean chair bottoms, draperies, window sills or the like, the operator withdraws the cleaning end of the wand 48 from the fitting 42. The flexible hose 46 allows the operator to manipulate the wand 44 as necessary to complete the cleaning operation.

As should further be appreciated from reviewing FIG. 1, a light source, generally designated by reference numeral 60, is carried on the wand 44. The light source 60 includes a housing 62 and a means for fastening the housing 62 to the wand 44. As illustrated, that means is a mounting band or bracket 64 that fits snugly around the outer periphery of the wand 44 and connects the light source directly to the wand. Of course, the band 64 is just one possible means for mounting the light source 60 to the wand 44 and substantially any other appropriate structure could be utilized including velcro, screws or other fastening mechanisms.

One or more light emitting diodes 66 are provided in the front face 68 of the housing 62. The light emitting diodes 66 may be powered through a circuit board (not shown) that receives power from the electrical wall outlet. Alternatively, the light emitting diodes 66 may be powered by a battery (not shown) held in the housing 62 or provided in the nozzle or canister assemblies 14, 16 of the vacuum cleaner 10. In either arrangement, the light emitting diodes 66 direct light over the cleaning end 48 of the wand 44 and any cleaning tools that might be connected thereto in order to illuminate the working area and allow the operator to see better when cleaning. Advantageously, a light source 60 positioned on the wand 44 in the manner described ensures that the light is directed at a point where it most benefits the operator.

Figure 2:
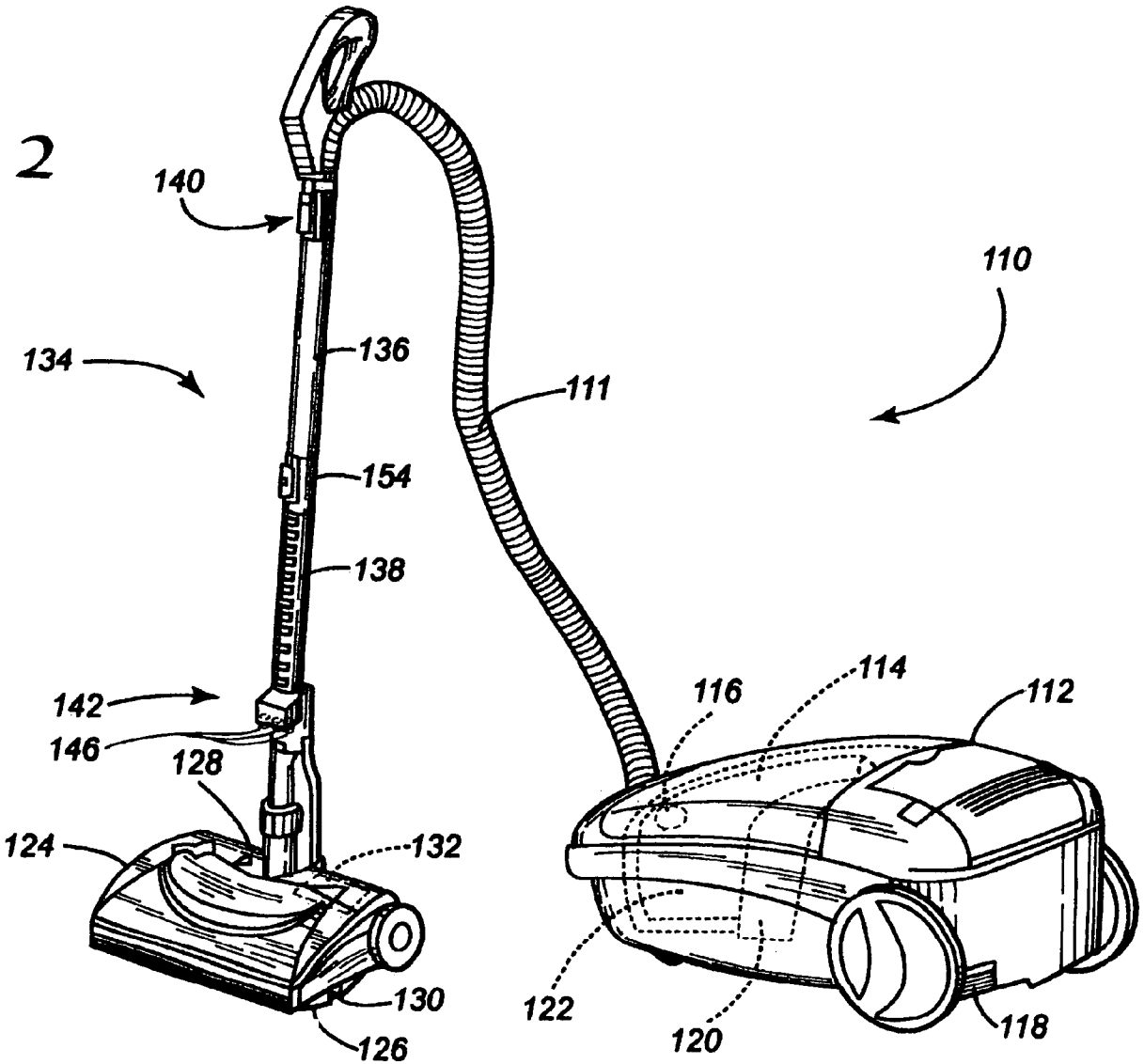
FIG. 2 is a perspective view of a canister vacuum cleaner also equipped with a lighted wand assembly.

FIG. 2 illustrates a canister vacuum cleaner equipped with the hand cleaning tool 12 of the present invention. More particularly, the canister vacuum cleaner 100 includes a hose 111 and a canister housing 112. The canister housing 112 includes an internal chamber 114 as well as a suction inlet 116 and an exhaust outlet 118 both communicating with that chamber. A suction generator, in the form of a fan and motor assembly generally designated by reference numeral 120 is held in the chamber 114. Additionally, a dust collector in the form of a dust bag 122 is held in the internal chamber 14 between the suction inlet 16 and the suction generator 20.

The vacuum cleaner 110 also includes a nozzle 124 for picking up dirt and debris. The nozzle 124 includes an inlet 126 and an outlet 128. The nozzle houses a motor driven agitator 130 and a drive motor 132 for driving the agitator. A telescoping wand assembly generally designated by reference numeral 134 operatively connects the nozzle 124 to the hose 111 that is connected to the suction inlet 116 of the canister housing 112.

As further illustrated, a light source 142 is provided on the telescoping wand assembly 134 including first and second sections 136, 138. The light source is held in position by a band 144. The light source 142 is identical to the light source 60 in the embodiment shown in FIG. 1 and includes one or more light emitting diodes 146 for directing light over the cleaning end 148 of the wand 134. This is particularly beneficial when the wand 134 is disconnected at the coupling 150 from the powerhead and manipulated for purposes of above floor cleaning. More particularly, the added light source 142 allows the operator to do a better job when cleaning.

Figure 3:
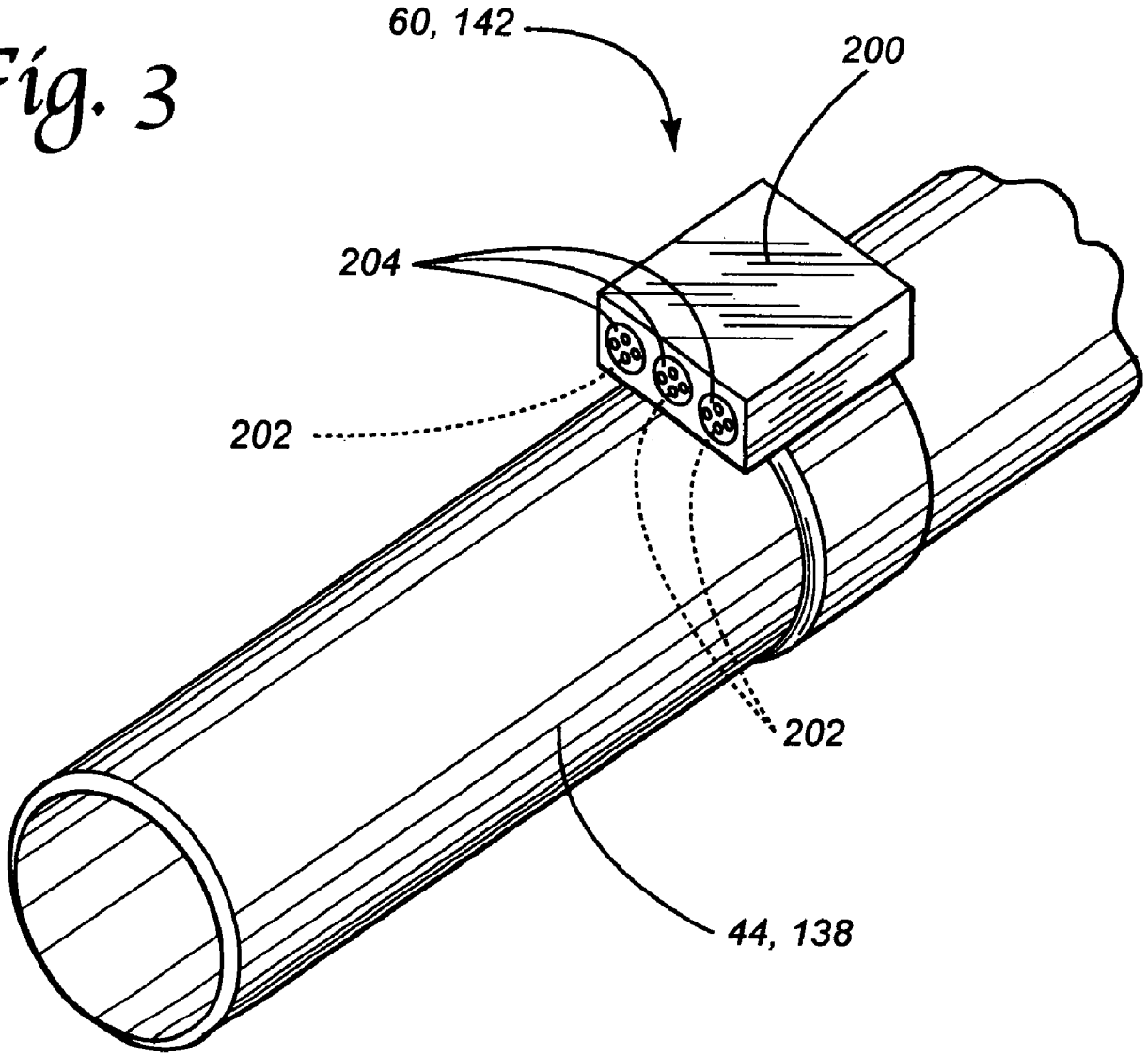
FIG. 3 is a detailed perspective view of the light source and mounting band/bracket connecting the light source to the wand.

A detailed illustration of the light source 60, 142 is presented in FIG. 3. The light source 60, 142 includes a housing 200 holding three LEDs, incandescent bulbs, flourescent bulbs, halogen bulbs or xenon bulbs 202. Light from the LEDs/bulbs 202 is directed by lenses and/or prisms 204 along the wand 44, 138 onto a work area to be cleaned.

Figure 4:
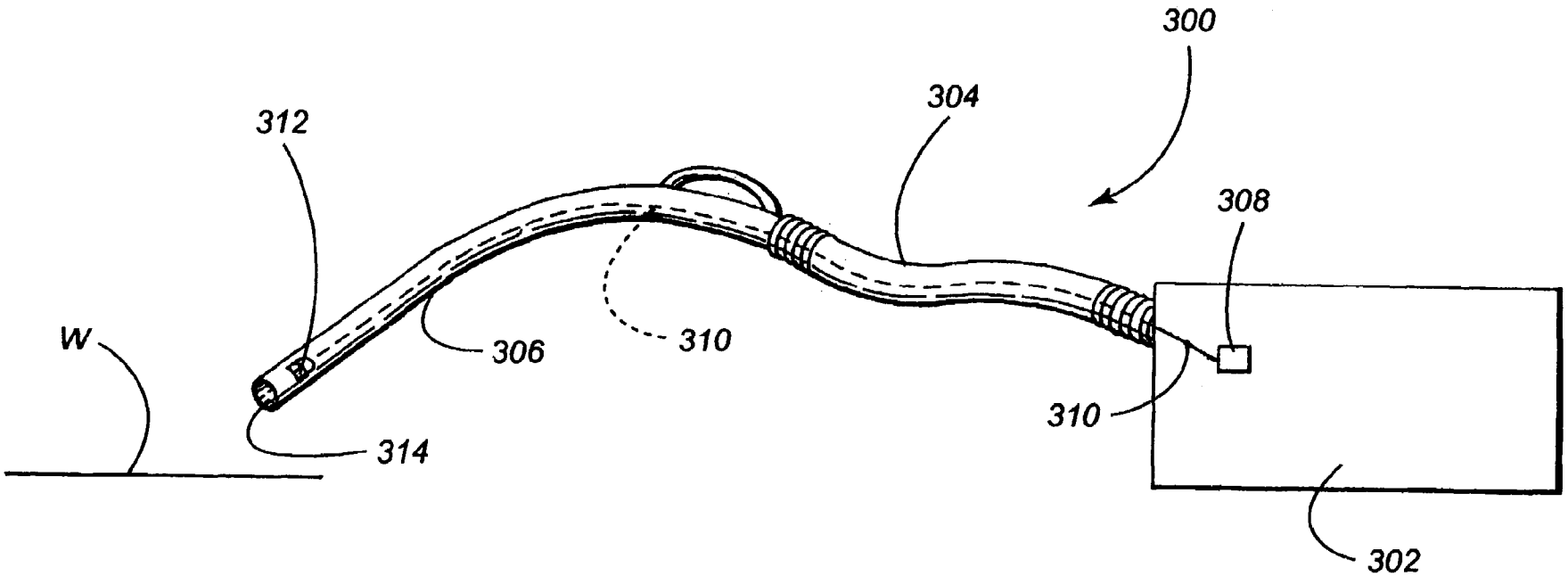
FIG. 4 is a schematical representation illustrating an embodiment wherein the light source is remotely located on the floor care apparatus yet still illuminates the work area adjacent the cleaning end of the wand.

FIG. 4 illustrates an embodiment of the present invention wherein the light source is positioned remote from the light outlet on the wand. More specifically, the floor care cleaning apparatus 300 includes a housing 302, a hose 304 and a wand 306. A light source 308 is provided and carried at a first point on the housing 302. A light transmitter 310 extends from the remote light source 308 to a second point on the wand 306. The light transmitter 310 may, for example, be a light pipe, a fiber optic cable, a fiber optic strand or any combinations thereof capable of extending through the hose 304 and wand 306 as illustrated.

The light from the light source 308 may simply be transmitted out of the second end of the transmitter 310 onto the work area W. Alternatively, a light director 312 may be operatively connected to the second end of the transmitter 310. Such a director 312 is provided to better focus the light onto the work area. Such a director 312 may, for example, include a lens, a prism, a reflector, a mirror or a combination thereof.

In the illustrated embodiment, the light source 308 is shown on the main housing 302. It should be appreciated that it could be provided anywhere on the apparatus 300 remote from the outlet near the end of the wand. Thus, the light source 308 may be conveniently located anywhere on the apparatus 300. As a result, the light source 308 may be positioned where space is readily available, where it is protected from bumping and jarring that might otherwise lead to premature failure, and/or where the weight of the light source may be more readily accommodated without adversely affecting the balance and/or manipulatability of the wand. Further, while the light outlet is illustrated on the wand 306, it should be appreciated that it could just as easily be provided on a cleaning tool received over the cleaning end 314 of the wand.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the vacuum cleaner could include a single agitator or more than two agitators. The vacuum cleaner could include a dust bag rather than a dirt cup. Further, while the light source 60, 142, 308 of the illustrated embodiment is described as being light emitting diodes 66, 146, other light sources could be used. For example, the light source could comprise light emitting diodes, incandescent bulbs, flourescent bulbs, xenon bulbs and/or halogen bulbs. Substantially any known source of light could be utilized.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A canister vacuum cleaner, comprising:

a main housing;

a dirt collector carried by said main housing;

a suction generator carried by said main housing;

a wand having a first end and a second end;

a hose providing fluid communication between said first end of said wand and said suction generator;

a light source carried on said canister vacuum cleaner at a first point; and a light transmitter extending along said hose and said wand from said light source at said first point to a second point on said canister vacuum cleaner remote from said first point whereby light from said light source is directed past said second end of said wand onto a surface being cleaned.

2. The vacuum cleaner of claim 1 wherein said dirt collector is a dirt cup.

3. The vacuum cleaner of claim 1 wherein said light source is a light emitting diode.

4. The vacuum cleaner of claim 1 wherein said light source is an incandescent bulb.

5. The vacuum cleaner of claim 1 wherein said light source is a flourescent bulb.

6. The vacuum cleaner of claim 1 wherein said light source is a halogen bulb.

7. The vacuum cleaner of claim 1 wherein said light source is a xenon bulb.

8. The vacuum cleaner of claim 1 wherein a light director is carried on said canister vacuum cleaner at said second point, said light director being selected from a group consisting of a lens, a prism, a reflector, a minor or a combination thereof.

9. The vacuum cleaner of claim 1, wherein said light transmitter is selected from a group consisting of a light pipe, a fiber optic cable, a fiber optic strand and combinations thereof.

10. A floor cleaning apparatus, comprising:

a nozzle assembly with a suction opening;

a canister assembly pivotally connected to said nozzle assembly;

a suction generator carried by one of said canister assembly and said nozzle assembly;

a dirt collector carried by one of said canister assembly and said nozzle assembly;

a wand and hose assembly carried by one of said canister assembly and said nozzle assembly and in selective fluid communication with said suction generator;

a light source carried on said floor cleaning apparatus at a first point; and a light transmitter extending along said wand and hose assembly substantially between said first point and a second point on said floor cleaning apparatus whereby light from said light source is directed past said wand onto a surface being cleaned.

11. The floor cleaning apparatus of claim 10 wherein said dirt collector is a dirt cup.

12. The floor cleaning apparatus of claim 10 wherein said light source is a light emitting diode.

13. The floor cleaning apparatus of claim 10 wherein said light source is an incandescent bulb.

14. The floor cleaning apparatus of claim 10 wherein said light source is a flourescent bulb.

15. The floor cleaning apparatus of claim 10 wherein said light source is a halogen bulb.

16. The floor cleaning apparatus of claim 10 wherein said light source is a xenon bulb.

17. The vacuum cleaner of claim 10 wherein a light director is carried on said floor cleaning apparatus at said second point, said light director being selected from a group consisting of a lens, a prism, a reflector, a mirror or a combination thereof.

18. The vacuum cleaner of claim 10 wherein said light transmitter is selected from a group consisting of a light pipe, a fiber optic cable, a fiber optic strand and combinations thereof.

* * * * *